US008904678B2

(12) United States Patent
Dennis et al.

(10) Patent No.: US 8,904,678 B2
(45) Date of Patent: Dec. 9, 2014

(54) VOICE AMPLIFIED FOAM MUSIC GREETING CARD

(71) Applicant: American Greetings Corporation, Cleveland, OH (US)

(72) Inventors: Erin Dennis, Lakewood, OH (US); Michelle Parkinson, Garfield Heights, OH (US)

(73) Assignee: American Greetings Corporation, Cleveland, OH (US)

( * ) Notice: Subject to any disclaimer, the term of this patent is extended or adjusted under 35 U.S.C. 154(b) by 237 days.

(21) Appl. No.: 13/677,892

(22) Filed: Nov. 15, 2012

(65) Prior Publication Data

US 2013/0283653 A1 Oct. 31, 2013

Related U.S. Application Data

(60) Continuation-in-part of application No. 13/459,553, filed on Apr. 30, 2012, now abandoned, which is a division of application No. 13/004,544, filed on Jan. 11, 2011, now Pat. No. 8,205,365.

(51) Int. Cl.
*G09F 1/00* (2006.01)
*G09F 27/00* (2006.01)

(52) U.S. Cl.
CPC .. *G09F 27/00* (2013.01); *G09F 1/00* (2013.01)
USPC ..... 40/124.03; 446/81; 446/297; 446/298; 446/299

(58) Field of Classification Search
CPC ..... G09F 27/00; G09F 1/00
USPC ..... 40/124.03; 446/81, 298, 299, 297
See application file for complete search history.

(56) References Cited

U.S. PATENT DOCUMENTS

| | | | | |
|---|---|---|---|---|
| 4,186,519 | A | 2/1980 | Repka | |
| 4,272,915 | A * | 6/1981 | Noble | 446/298 |
| 5,640,459 | A | 6/1997 | Hedeen | |
| 7,867,055 | B2 | 1/2011 | Todokoro | |
| 8,256,150 | B2 * | 9/2012 | Qiao et al. | 40/124.03 |

* cited by examiner

*Primary Examiner* — Syed A Islam
(74) *Attorney, Agent, or Firm* — Christine Flanagan

(57) ABSTRACT

Three-dimensional lightweight foam greeting cards are described herein having a foam body with a perimeter wall that extends between two spaced apart parallel pieces of planar sheet material such as heavy gauge paper, cardboard, or other such material. The greeting cards have a partially hollowed foam body or one or more cavities in the foam body concealed in the front and back by the planar sheet material which may be pre-cut in the shape of the foam body are decorated consistent with the design of the foam body. The cavities in the foam body may contain various electronic components that enable the greeting card to produce sound, record and playback a personalized message, trigger light activation, trigger the movement of moveable parts, display digital video, photographs or slideshows, or a combination thereof.

20 Claims, 10 Drawing Sheets

VOICE AMPLIFIED FOAM MUSIC GREETING CARD

RELATED APPLICATIONS

This application is a continuation of and claims priority to U.S. patent application Ser. No. 13/459,553, filed on Apr. 30, 2012, which claims priority to U.S. patent application Ser. No. 13/004,544, filed on Jan. 11, 2011. All of the above-referenced Patent Applications are incorporated herein by reference in their entirety.

FIELD OF THE INVENTION

The present invention relates to greeting cards, and more specifically to three-dimensional foam greeting cards and decorative greeting card accessories.

BACKGROUND OF THE INVENTION

For many years paper greeting cards have been widely used for celebratory occasions such as birthdays, graduations, weddings and other commercial purposes. Traditional text information is generally found on paper greeting cards. More recently, sound has been added to traditional paper greeting cards to increase the personalization of the cards by delivering an audio message that is electronically embodied in circuitry that is carried within the greeting card. The ability to use sound in combination with printed matter such as with conventional printed greeting cards significantly enhances the communicative value of social and relational greetings. The availability of small voice recording sound modules has made sound-generating greeting cards increasingly popular. Small lighting systems have also been incorporated into social greeting products and novelties, and combined in circuits with sound and other features.

SUMMARY OF THE INVENTION

A three-dimensional foam greeting card is described herein, in one embodiment, having a three-dimensional foam body, a first planar surface material attached to a front surface of the three-dimensional foam body, a second planar surface material attached to a back surface of the three-dimensional foam body and a sound module located in a recess in the three-dimensional foam body and concealed by the first and second planar surface material. The sound module may include a speaker, circuit board, integrated circuit, microprocessor, memory device, power source, at least one switch mechanism and at least one pre-loaded digital audio file. The at least one switch mechanism controls playback of the at least one pre-loaded digital audio file.

In another embodiment, the three-dimensional foam greeting card of the present invention contains a three-dimensional foam body having at least one hollowed out portion creating a cavity therein, a first planar surface attached to a front surface of the three-dimensional foam body, a second planar surface attached to a back surface of the three-dimensional foam body, a sound module comprising a speaker, circuit board, integrated circuit, microprocessor, power source, memory device and at least one pre-loaded audio file, a recording device, a first switch to initiate a user recording session, and a second switch to initiate playback of the at least one pre-loaded audio file or a user recorded message.

In still another embodiment, the foam greeting card contains a three-dimensional foam body with a perimeter wall which extends between two spaced apart parallel pieces of heavy gauge planar sheet material, and a multimedia player device located and concealed within the three-dimensional foam body. The multimedia player device may include a circuit board, integrated circuit, microprocessor, speaker, power source, memory device, an electronic display screen operative to display digitally generated images, a data storage device, at least one switch mechanism, and at least one pre-loaded digital audio or video file. The electronic display screen is visible through an opening in the three-dimensional foam body and one of the pieces of heavy gauge planar sheet material.

DETAILED DESCRIPTION OF PREFERRED AND ALTERNATE EMBODIMENTS

The present disclosure and related inventions provide foam constructs in the form of greeting devices, greeting cards, novelties, gifts and foam constructs with functional features, and which can be used in connection with other devices such as retail displays.

Figure 3:
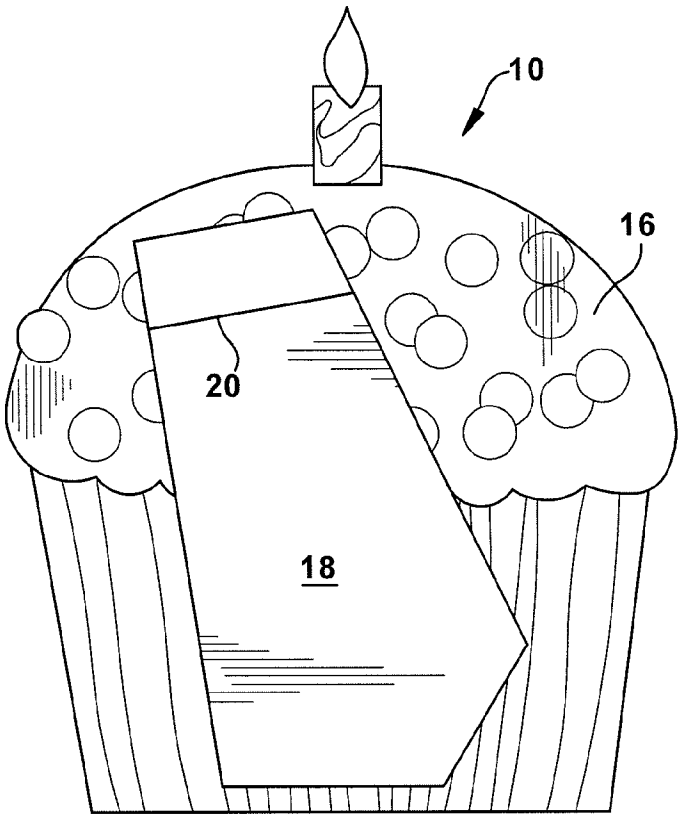
FIG. 3 is a rear view of the three-dimensional foam greeting card of FIG. 1.
Figure 2:
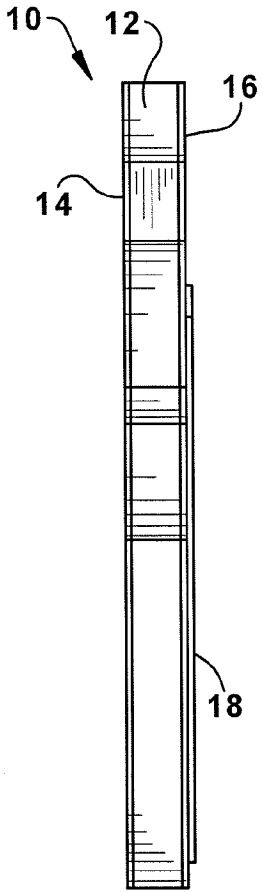
FIG. 2 is a side view of the three-dimensional foam greeting card of FIG. 1.
Figure 9:
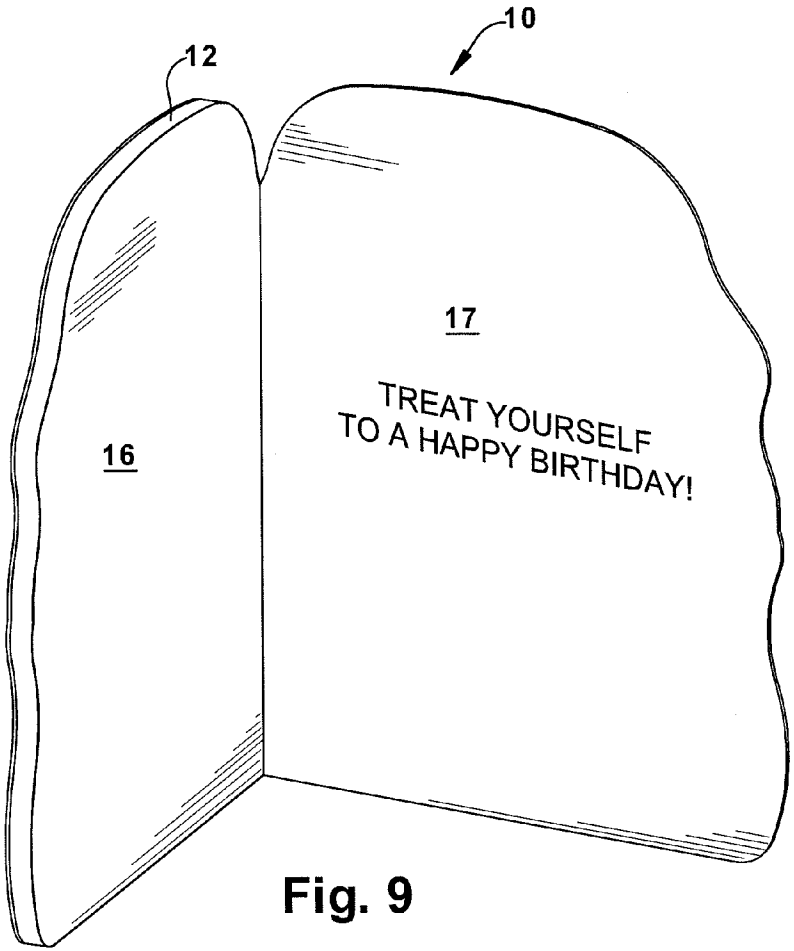
FIG. 9 is a perspective view of the three-dimensional foam greeting card of FIG. 8 in an open position.
Figure 8:
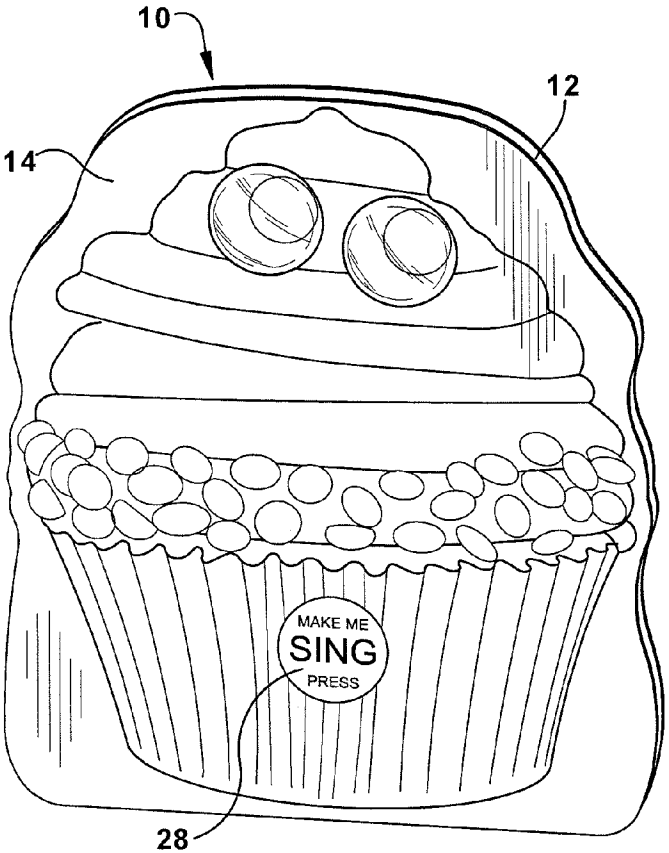
FIG. 8 is a front view of an alternate embodiment of the three-dimensional foam greeting card of the present invention in a closed position.

In one form, a three-dimensional foam greeting card according to the present invention contains a foam body made of a hardened foam or foam-like material which makes the greeting card very lightweight. A representative example is shown in FIGS. 1-4. The foam body 12 of the greeting card 10 can be formed into any shape or profile, examples of which include, but are not limited to: a circle, a cupcake, a candle, an animal, a person, a baby carriage, a Christmas tree, a pumpkin, or any other conceivable shape. Or the greeting card 10 may take on a square or rectangular shape of a traditional greeting card. A portion of the foam body 12 is hollowed out to accommodate a device, examples of which include, but are not limited to: a sound module (shown in FIG. 4), a light module, a motor module, a multimedia player device or any combination thereof. There may be multiple cavities formed in the foam body 12 to receive multiple devices or device components such as batteries, switches, circuit boards, speakers, motors, recording devices, etc. The front and back surfaces of the foam body 12 are generally planar and can be covered with a heavy gauge paper-like material such as paper, cardboard, cardstock, or any other sheet or planar material. The outer paper-like surface 14, 16 can be cut in the shape of the foam body 12 and pre-printed with a design consistent with the shape of the foam body 12. The front surface 14 may bear decoration consistent with a front view of the item and the back surface 16 may contain decoration consistent with the back view of the item. For example, if the foam body and outer cover contain the shape and decoration of a dog, the front cover of the foam greeting card may contain the right side profile of the dog and the back cover may contain the left side profile of the dog. The outer surfaces 14, 16 are adhesively or otherwise attached to the foam body 12. The greeting card 10 may contain, in addition to the three-dimensional foam body 12 with planar front 14 and back 16 surfaces, a sentiment panel 17, which may be connected to the planar sheet material located on either the front 14 or back 16 surface of the foam body 12. This configuration is shown in FIGS. 8 and 9. The sentiment panel 17 may be, as shown, shaped in the same way as the foam body 12 and corresponding front 14 and back 16 sheet materials. If the sentiment panel 17 is connected along a fold line to the planar sheet material located on the front surface 14 of the foam body 12, it would serve as an outside front cover and an inside left panel of the greeting card 10. In a closed position, the sentiment panel 17 would be folded over the front surface 14 of the foam body 12 revealing only the outer surface of the sentiment panel 17. In an open position, it would be folded away from and revealing the front surface 14 of the greeting card 10 and the inner surface of the sentiment panel 17. Text sentiment and/or printed photographs or graphics may be contained on both the inside and outside surface of the sentiment panel. If the sentiment panel is connected along a fold line to the planar sheet material located on the back surface 16 of the foam body 12, as is shown in FIG. 9, it would serve as an outside back cover of the greeting card 10 and an inside right panel of the greeting card 10. In a closed position, the sentiment panel 17 would be folded over the back surface 16 of the greeting card 10. In an open position, it would be folded away from the back surface 16 of the greeting card 10 revealing the back surface 16 of the greeting card 10 and the inner surface of the sentiment panel 17. The three-dimensional greeting card 10 may additionally contain a display arm 18 attached to the back surface 16 of the greeting card 10, as shown in FIG. 3. The display arm 18 may be made out of cardboard or other rigid material. The upper portion of the display arm 18 is creased along a fold line 20 so that the display arm 18 may bend outward to function as a support for the greeting card 10, allowing the greeting card 10 to be displayed in a standing position.

Figure 4:
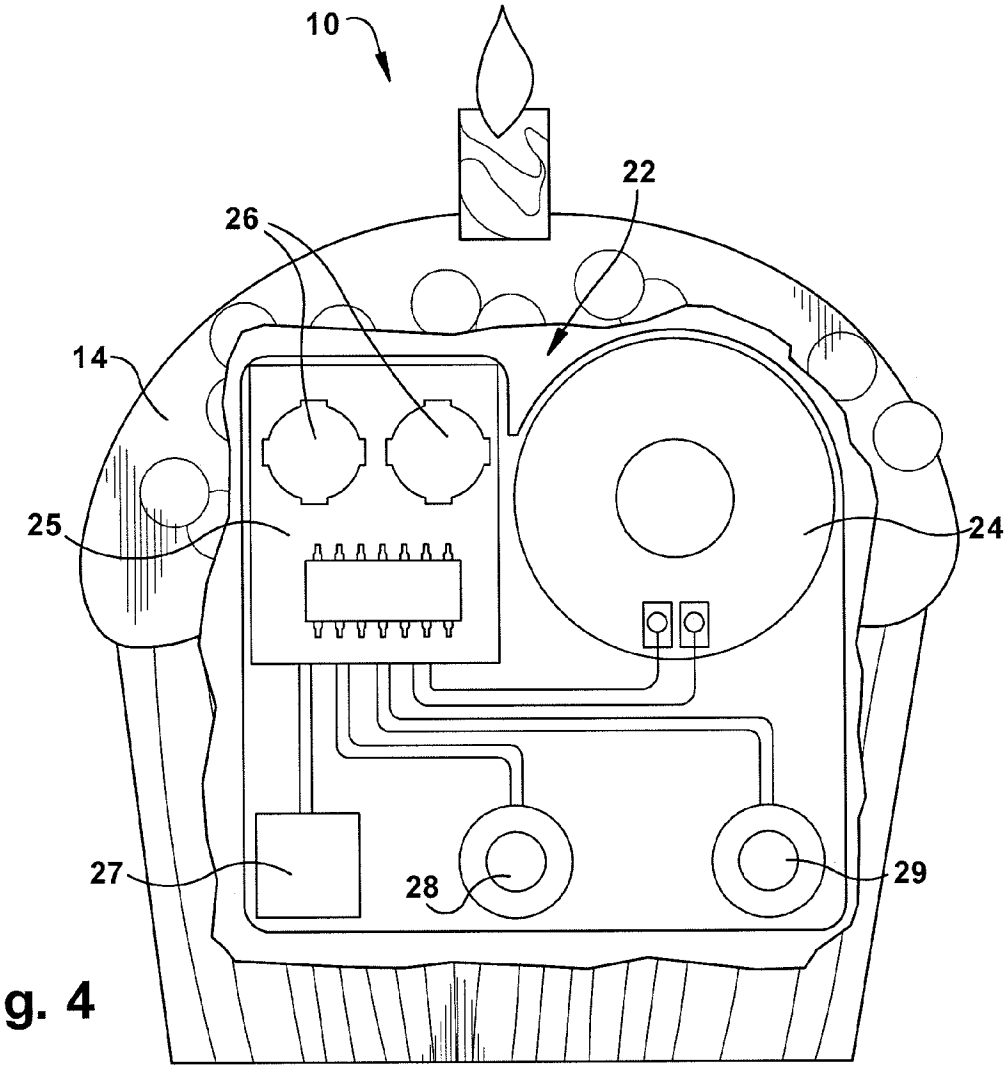
FIG. 4 is a front internal view of the three-dimensional foam greeting card of FIG. 1.

In another embodiment, the foam greeting card, as described above, may contain a sound module 22, as shown in FIG. 4. Components of the sound module may include a circuit board 25, an integrated circuit, a microprocessor, a speaker 24, a memory module, a power source 26, a switch 28, and any other components necessary to trigger and playback a pre-recorded digital audio file. The digital audio file may contain music, singing, a voice message, or any other recordable sound. Components of the sound module 22 may be contained and concealed within a hollowed out portion of the foam body 12. The switch 28 which triggers playback of the audio file may be an electro-mechanical push-button switch 28. This type of switch may be implemented as a press-button 28, wherein each time a user presses the button, playback of the audio file is initiated. A sticker or printed label may be placed above the press-button switch on the outer surface 14 of the greeting card 10 to indicate that this is the area the user must press to playback the audio file. The sticker or printed label may simply say "play" or "press here". Alternatively the surface of the greeting card 10 above the press-button may be printed with words and/or indicators to designate the location of the push-button 28. The switch may alternatively be a mechanical on/off switch which may be located on the front or back surface of the foam greeting card or it may also be located along the perimeter of the foam body 12. A slide trigger switch may also be used to initiate playback of the pre-recorded digital audio file. This type of switch may be particularly used with a foam greeting card having a sentiment panel, as described above, attached to the front or back surface of the greeting card. A slide switch mechanism may be placed over a fold line between the sentiment panel and the foam body such that when the greeting card is opened by moving the sentiment panel away from the foam body, the slide trigger activates the pre-recorded audio. Other switch mechanisms may be used such as light sensitive switches, motion sensitive switches, touch sensitive switches, pressure sensitive switches, thermal switches, moisture or capacitive switches or any other switch which would be known to one skilled in the art.

Figure 1:
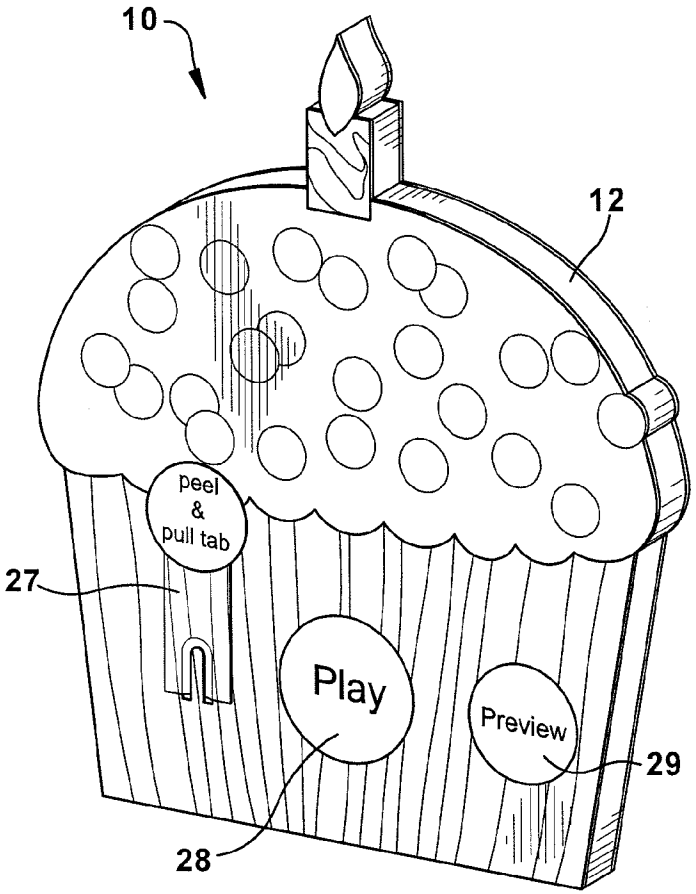
FIG. 1 is a perspective view of a first embodiment of the three-dimensional foam greeting card of the present invention.

In another embodiment, the three-dimensional foam greeting card, as described above, contains both a sound and recording module that provide the user with the ability to record a personalized message to the card recipient. As shown in FIGS. 1 and 4, this embodiment may include at least two electro-mechanical switches 28, 29 to initiate a recording session and a playback session and a microphone. A first switch 28 or "play" button, which may be implemented as a push-button switch as described above, may in a first mode initiate playback of a pre-recorded message instructing the user how to record a personal message and in a second mode initiate playback of the user's personal message. A second switch 29, or "preview" button, which may also be implemented as a push-button, may initiate a recording session wherein the user may record a personal message to the greeting card recipient. A third switch 27 or pull tab is located on the outer surface of the greeting card. This third switch 27 controls whether the greeting card 10 is in a first mode, wherein a user can test the card functionality by recording and previewing the recorded message without the ability to play the message a second time or to hear the message upon pressing the "play" button, or a second mode, wherein the user has purchased the greeting card, and removed the pull tab 27 thereby permitting the user to record a message which is then saved within the sound module and is thereby available for playback upon pressing the "play" button 28. The third switch or pull tab 27 may be located on the outer surface of the greeting card 10 so that is visible to the purchaser. While the pull tab 27 is still intact, pressing the "play" button will initiate playback of a pre-recorded voice message instructing the user how to record a personal message. Once the pull tab 27 has been removed, pressing the "play" button 28 will initiate playback of the user-recorded message. Pressing the "preview" button 29 initiates a recording session, regardless of whether the pull tab 27 has been removed or not. The recording session will continue as long as the user continues pressing or holding down the "preview" button 29 or until the amount of storage allotted for the user-recorded message has been exhausted. Once the user has finished recording the personal message, the personal message will automatically be played back. In the first mode, when the pull tab 27 is still intact, the user-recorded message is played back once and discarded, disabling further playback of the user-recorded message. In the second mode, once the pull tab 27 has been removed, the user-recorded message is immediately played back and saved so that it can be re-played by pressing the "play" button 28. The user may record over a previous message simply by pressing the "preview" button 29 and recording a new message which will overwrite the previously saved user-recorded message. The "preview" button 29 may be indicated on the outer surface of the greeting card by a removable sticker or label. Once the user purchases the greeting card and has recorded a satisfactory message, he/she can remove the "preview" sticker or label before sending the greeting card to the recipient.

Figure 6:
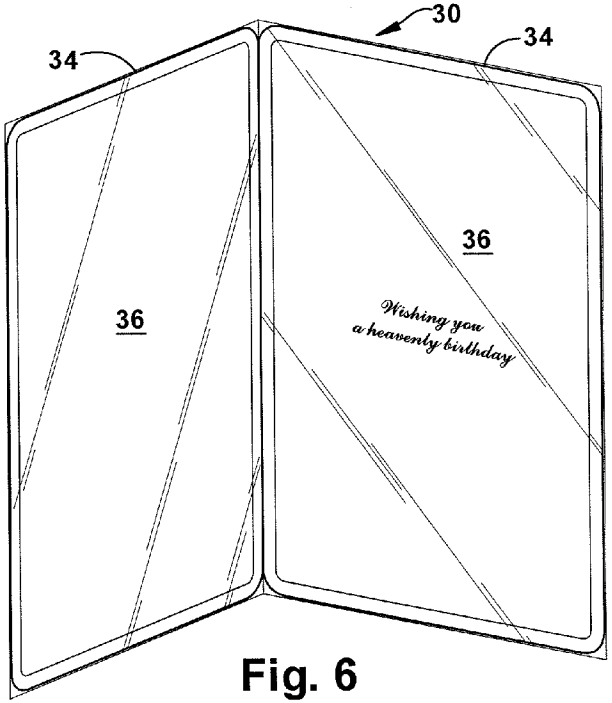
FIG. 6 is a perspective view of the three-dimensional foam greeting card of FIG. 5 in an open. position.
Figure 7:
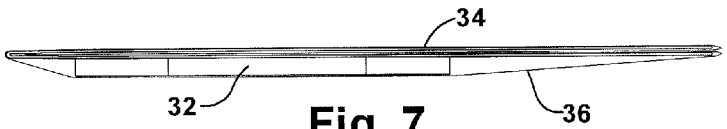
FIG. 7 is a top view of the three-dimensional foam greeting card of FIG. 5 in the direction of arrows 7-7.
Figure 5:
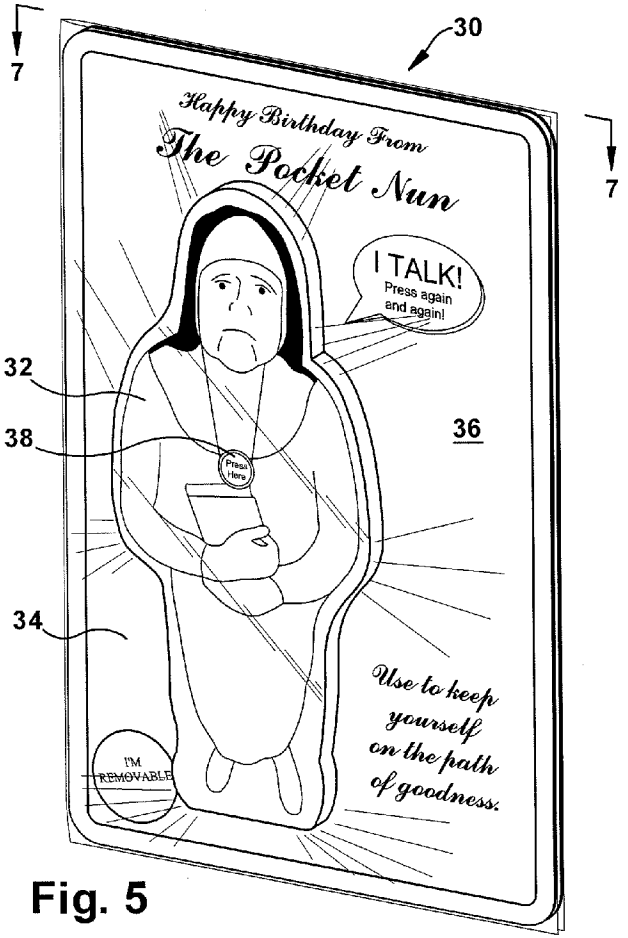
FIG. 5 is a perspective view of an alternate embodiment of the three-dimensional foam greeting card of the present invention in a closed position.

In another form, the three-dimensional foam greeting card of the present invention may be paired with a traditional paper greeting card, such as is shown in FIGS. 5-7. In this embodiment, the removable foam greeting card 32 may serve as a keepsake or token once the paper greeting 34 has been discarded. As shown in FIGS. 5-7, a sealed clear or transparent sleeve 36 made of plastic or other such material is used to pair the separate foam structure 32 and paper greeting card 34 in the same package. The foam structure 32 may be inserted into the sleeve 36 in front of the paper greeting card 34 so it is visible when looking at the greeting card 30 on a greeting card display. Alternatively, the foam structure 32 may be placed on the inside of the paper greeting card 34 to be discovered by the card recipient upon opening the greeting card 30. The foam structure 32 may contain sound, recording, light, motor, multimedia module, or combinations thereof as described in further detail below. As shown in the representative embodiment, the removable foam structure 32 contains a press button 38 which controls activation of an internal sound module, similar to the sound module shown in FIG. 4. Depression of the press button 38 may initiate playback of a pre-loaded audio file containing a voice message, music, sound, or any other digital recording.

Figure 11:
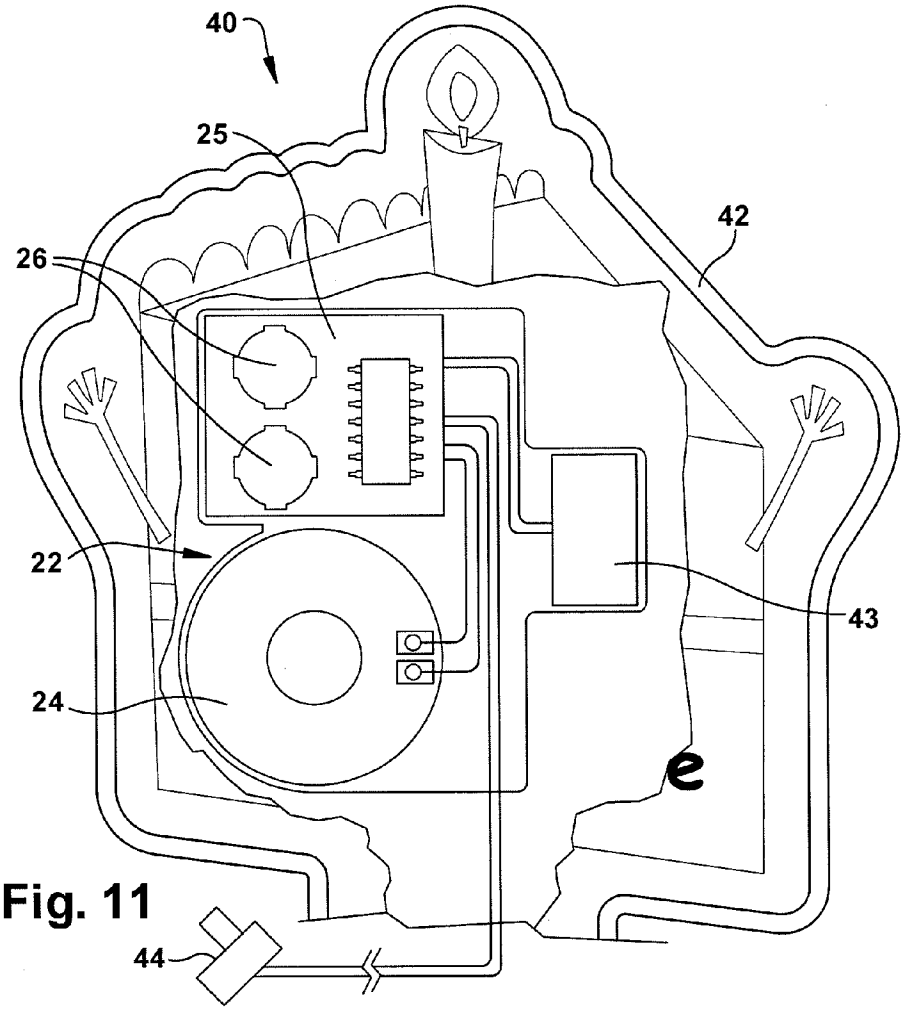
FIG. 11 is an internal view of a portion of the three-dimensional foam greeting card of FIG. 10.
Figure 10:
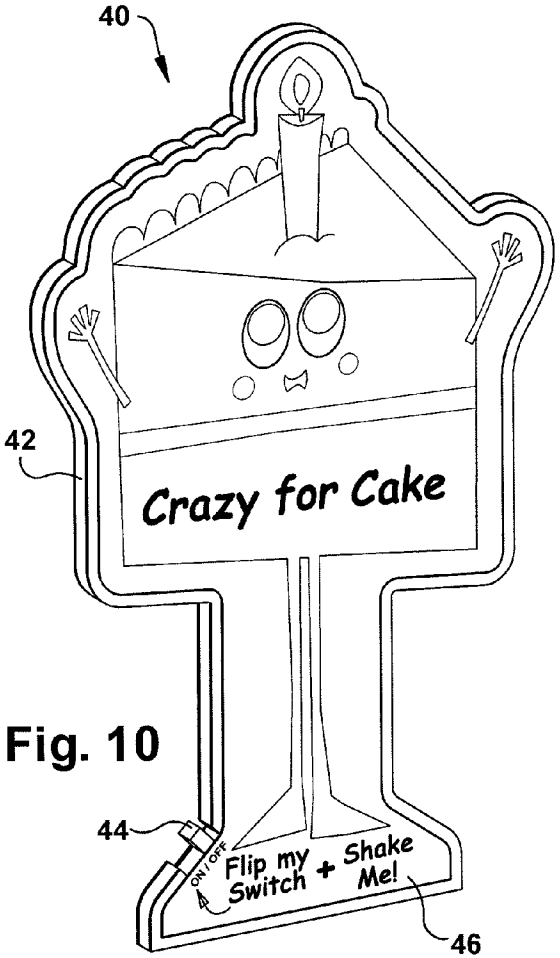
FIG. 10 is a perspective view of an alternate embodiment of the three-dimensional foam greeting card of the present invention.

The three-dimensional foam greeting card with sound, as described above, can additionally contain a motion sensor which operates to trigger one or more pre-loaded audio files. A representative example is shown in FIGS. 10-11. In this embodiment, in additional to the sound module 22 as described above, contains a motion sensor 43 within the cavity in the foam body 42. The motion sensor 43 can be used, in one embodiment, to trigger playback of a first pre-loaded audio file. In another embodiment, a first pre-loaded audio file may be played upon activating a first switch such as a push button switch or toggling a mechanical on/off button 44, as shown in FIGS. 10-11. After the first pre-loaded audio file is played back, movement of the foam body 42 activates the motion sensor 43, which triggers a second pre-loaded audio file. For example, the greeting card 40 may contain instructions to "shake me" 46 so that when the user begins to shake the foam body 42, the motion sensor 43 triggers playback of a pre-loaded audio file.

In another embodiment, the three-dimensional foam greeting card of the present invention may contain a light module with integrated LED lights. The light module would contain A light strand may be stored within a hollowed out portion of the greeting card body between the front and back surfaces of the card. The lights may be programmed to strobe in sequence or blink randomly. Different light colorations may be used as well. Other types of lighting, such as ribbon LED lights may also be used. An electro-mechanical push-activated switch may be used to allow the user to control whether the lights are turned on or off. Also, the lights may be used in combination with pre-recorded sound or a user-recorded message. A single switch may initiate playback of a pre-recorded or user-recorded message as well as turning the lights on or the audio playback and lights may be controlled by different switches.

In yet another embodiment, the three-dimensional foam greeting card of the present invention may contain a motor module located in the hollowed cavity in the foam located between the front and back panels of the greeting card. The motor module causes movement of at least one mobile object associated with the greeting card. The movement may be up and down motion, side to side lateral motion, or any other reciprocating motion. The motor module may contain a rotating gear mechanism that when activated turns a circular gear which is attached at one end to the mobile object. The mobile object can be any three dimensional object which extends outward from the front surface of the greeting card body. Activation of the motor module, which can be by a push button switch, slide switch, or any other switching mechanism, causes movement of the mobile object. Other novelties may be attached to the outside surface of the foam body such as moving eyes or other decorative embellishments.

Figure 13:
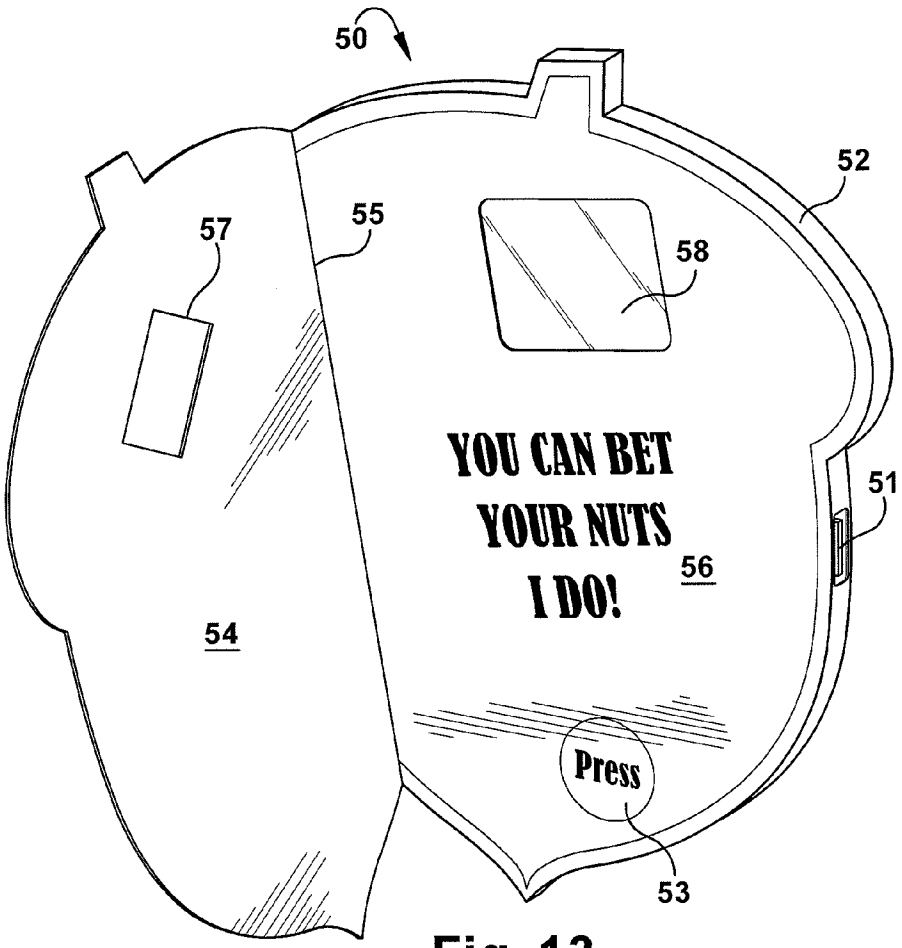
FIG. 13 is a perspective inside view of the three-dimensional foam greeting card of FIG. 12 in an open position.
Figure 12:
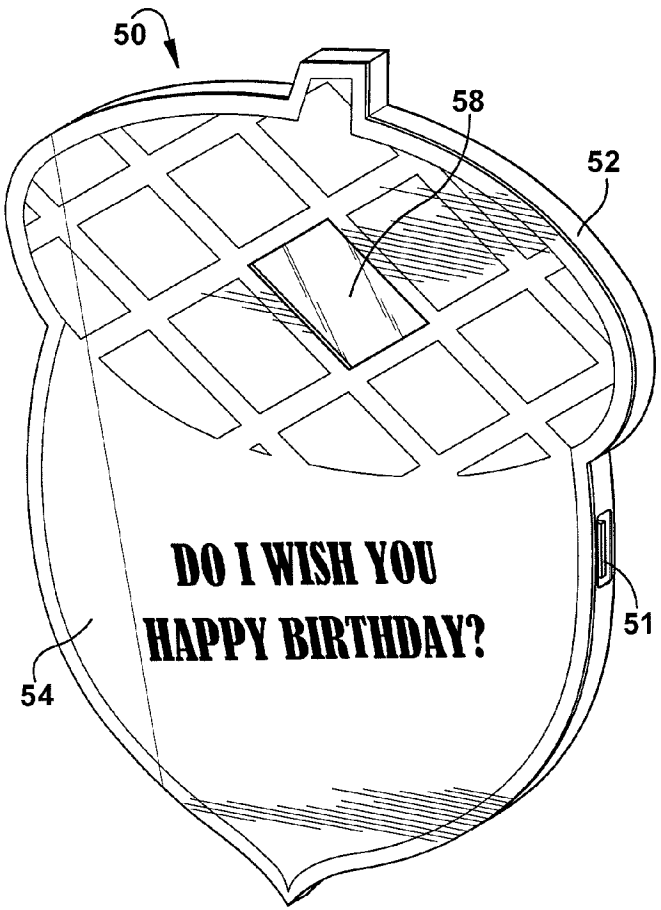
FIG. 12 is a perspective view of an alternate embodiment of the three-dimensional foam greeting card of the present invention in a closed position.
Figure 14:
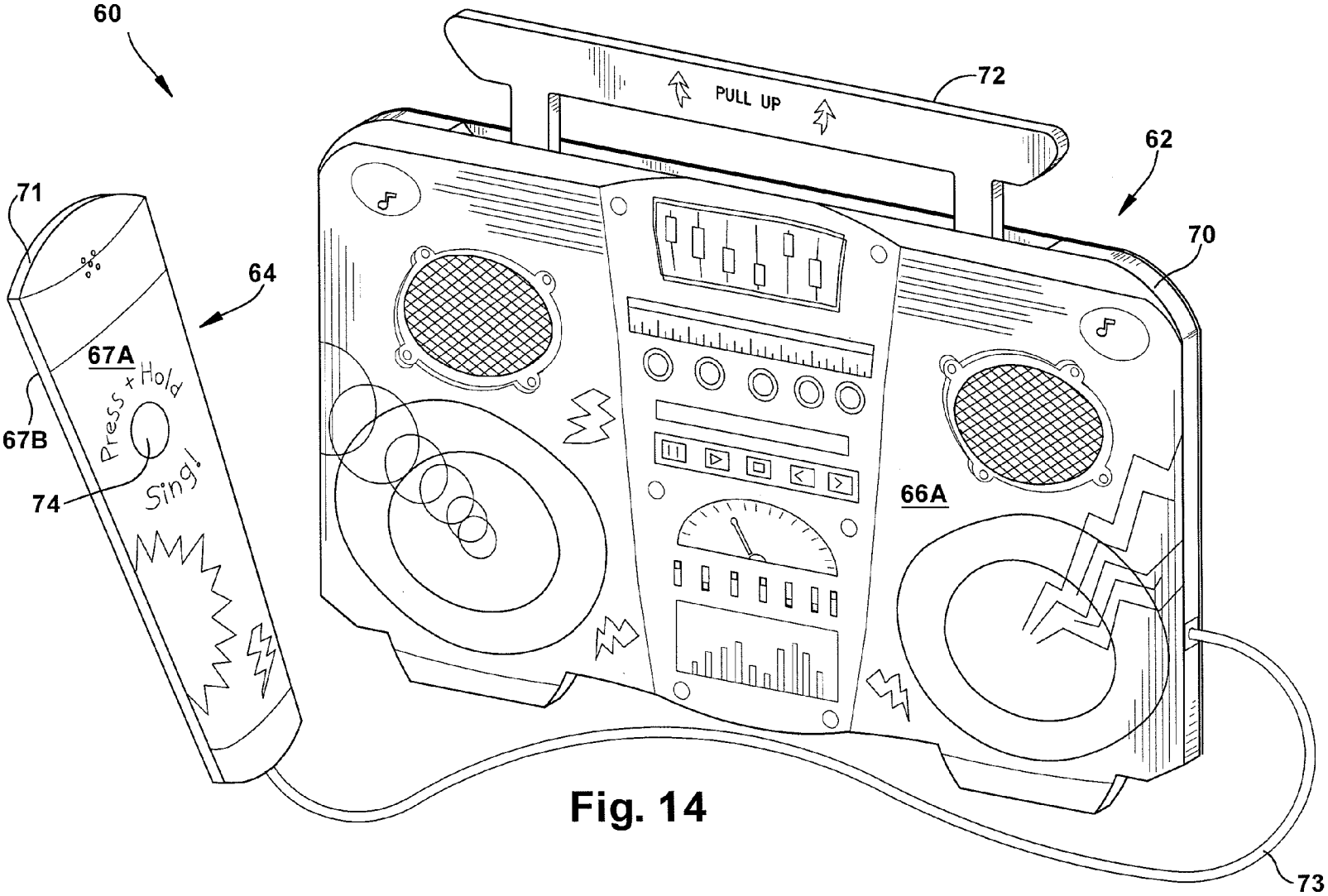
FIG. 14 is a perspective view of an alternate embodiment of the three-dimensional foam greeting card of the present invention, in a closed position.

In still another embodiment, the three-dimensional foam greeting card of the present invention may be operative to play pre-loaded video and/or audio recordings. In this embodiment, a representative example of which is shown in FIGS. 12 and 13, a multimedia player device is contained within the hollowed cavity in the foam body 52 located between the front and back panels of the greeting card 50. The multimedia player device may be capable of displaying pre-loaded images or video and emitting sound. Components of such multimedia player device may include, but are not limited to, a flat panel display screen 58, such as an LCD screen, a power source which preferably consists of one or more disposable batteries, an audio speaker, integrated circuit, a circuit board with microprocessor, a data storage device and related circuitry. The device may contain at least one pre-recorded slideshow with accompanying pre-recorded digital audio files. A representative device may store up to approximately 20 pre-loaded photos or images and between approximately 26 seconds to 2.26 minutes of audio or greater, depending on the amount of digital storage provided. The device, when powered by four disposable lithium batteries, is capable of playing the pre-loaded audio/visual content approximately 300 times. Representative width and/or height dimensions of a display screen 58 are between approximately 1.5 and 2.4 inches. The screen 58 may be visible through an opening in the planar sheet material located on the front surface 56 of the foam body 52. The foam greeting card body 52 may additionally contain a sentiment panel 54, as described above, which is attached along a fold line 55 to the planar sheet material attached to the front surface 56 of the foam body 52. The sentiment panel 54 would serve as the front cover of the greeting card 50 and in a closed position, lay atop the sheet material attached to the front surface 56 of the foam body 52. The sentiment panel 54 may also contain an opening thereon 57, consistent with the opening for the display screen 58 contained on the planar sheet material located on the front surface 56 of the foam body 52, through which the display screen 58, contained within the foam body 52, is visible. The multimedia display device may be activated by a push button switch 53 located on the front or back surface of the foam body 52. The greeting card 50 may contain the words "play" printed above the push button switch 53 which indicates where the multimedia player device is activated. Alternatively, the greeting card 50 may contain a slide switch which is used in combination with a sentiment panel 57, as described above. The slide switch may be located across a fold line 55 between the sentiment panel 54 and the foam greeting card body 52, such that when the greeting card 50 is opened or the sentiment panel 54 is folded away from the greeting card body 52, the slide switch works to activate the multimedia player. The greeting card 50 may additionally contain a mechanical on/off switch or button which controls whether or not the multimedia player device may be activated. The on/off switch may be located along the side perimeter of the foam body 52 between the planar sheet material located on the front and back surfaces of the foam body or it may be located on the front or back surface of the greeting card body.

A further embodiment of the three dimensional foam greeting card with multimedia player device, as described directly above, may contain audio recording capabilities which would provide a user with the ability to record a personalized message to be played before, during or after the pre-recorded slideshow is displayed on the display screen. Additional components such as a sound and recording module, as described above with reference to a previous embodiment, would accompany the multimedia player device within the cavity located within the foam body between the front and back panels of the greeting card. The multimedia player device may contain one or more pre-recorded audio files that may be played before during or after the personalized user recorded message.

Further still, the three dimensional foam greeting card with multimedia player device may additionally include a USB port 51, SD slot or any other appropriate external memory input source so that a user may upload digital video, digital photos and/or digital audio files to be presented on activation of the multimedia device. The multimedia device may be capable of playing several file formats including, but not limited to, flash, html, htm15, mp3, mp4, .mov, .rp4,/wma, etc. The multimedia player device may also contain one or more pre-loaded digital video, photo and/or audio files which may be played in combination with the user uploaded digital video, photo and/or audio. The video, slideshow and/or audio may be triggered by any of the switch mechanisms described herein and playback may further be controlled by a mechanical on/off switch. The switch mechanisms may be located on the front or back of the greeting card or along the side perimeter of the foam structure.

Figure 15:
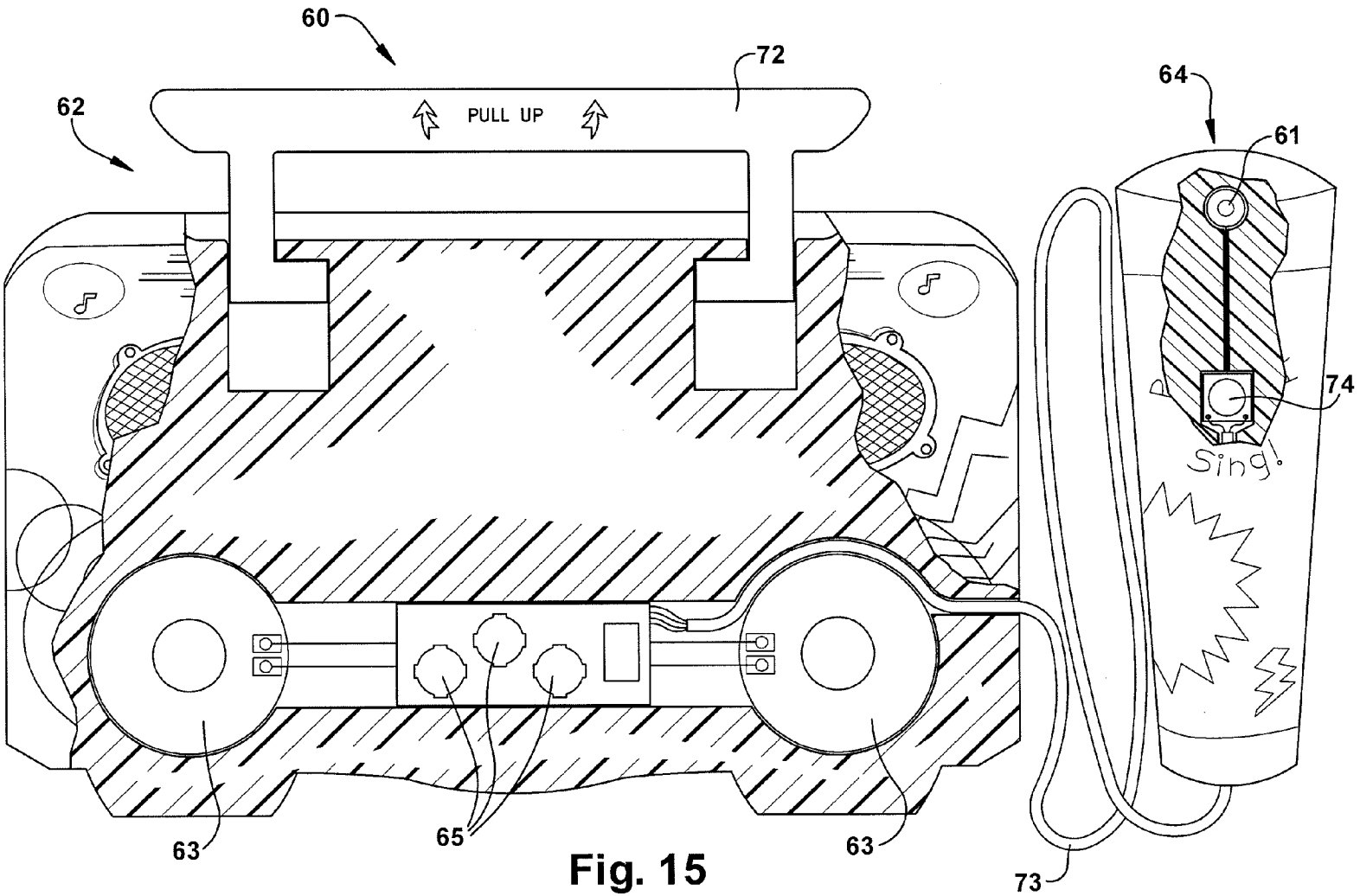
FIG. 15 is a front tear-away view of the greeting card of FIG. 14.
Figure 16:
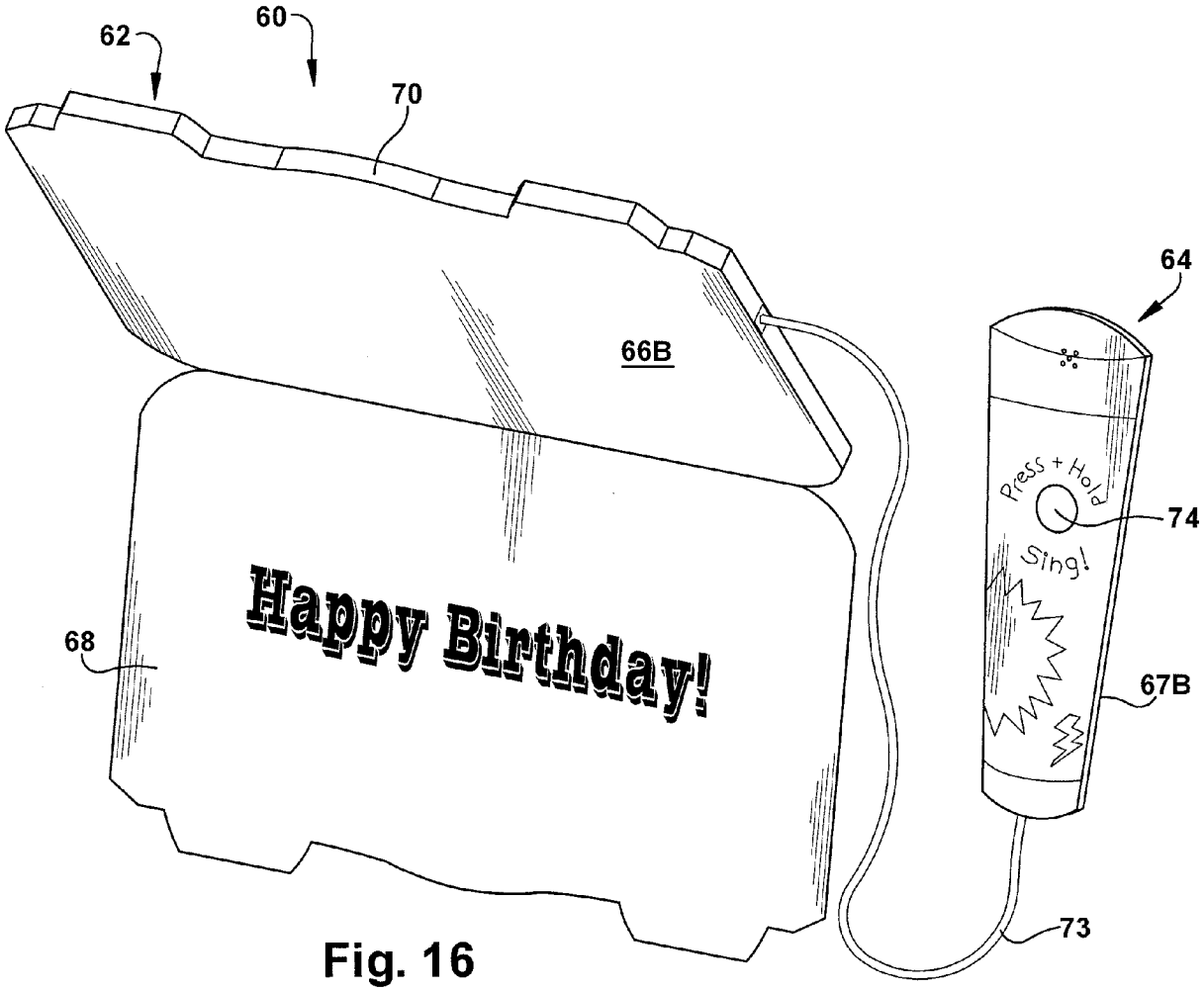
FIG. 16 is a perspective view of the greeting card of FIG. 14, in an open position.
Figure 17:
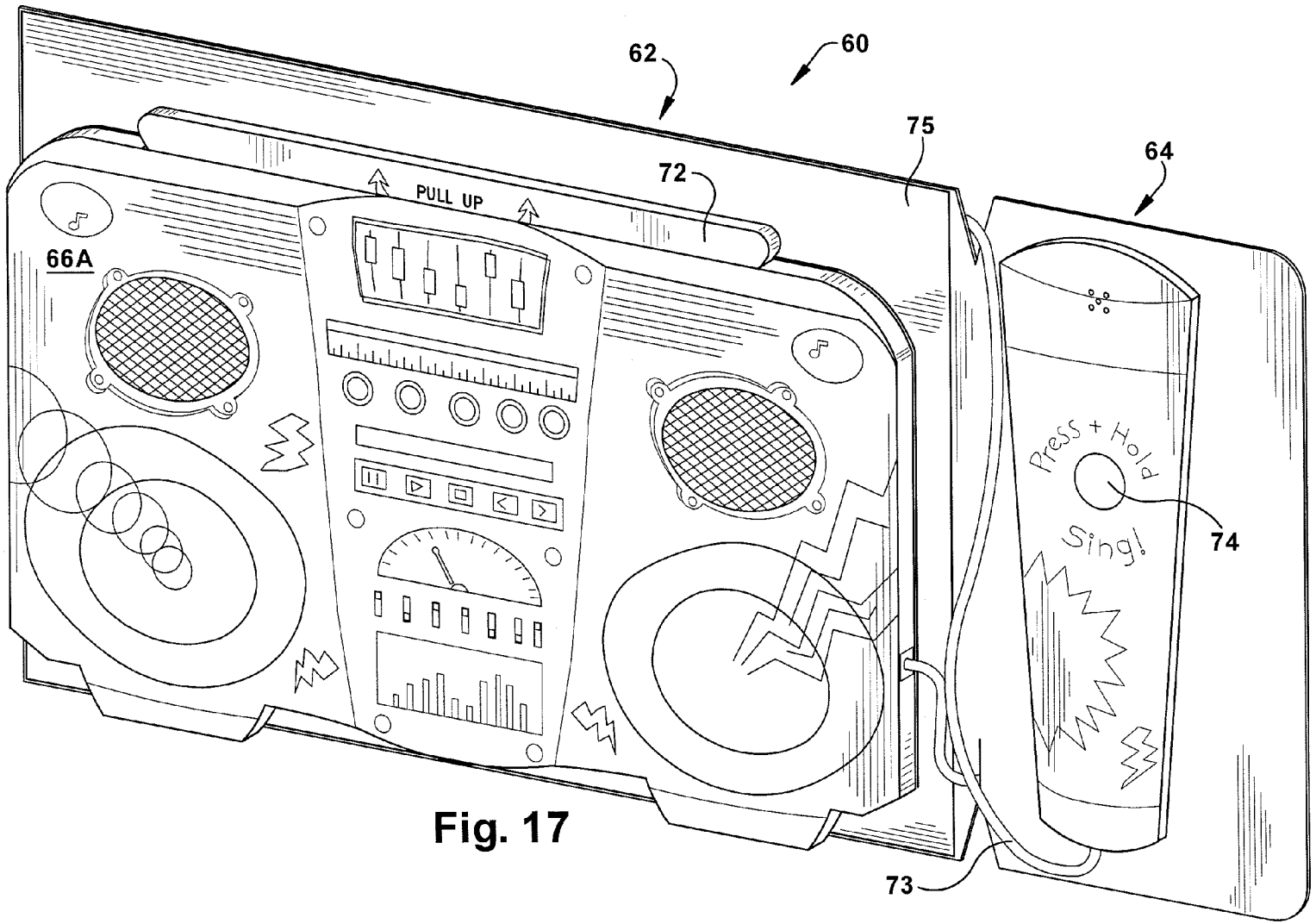
FIG. 17 is a perspective view of the greeting card of FIG. 15, enclosed in packaging material.

In another embodiment of the present invention, shown in FIGS. 14-17, two foam pieces 70, 71 are combined with various electronic components and a greeting card to provide the recipient the ability to sing into a faux microphone 64 along with background music emitting from a faux boom box 62 and have their voice and the background music amplified and projected through the speakers 65 of the faux boom box 62, karaoke-style. As described above with respect to the foam greeting card embodiments, the faux boom box 62 and faux microphone 64 are made of hardened foam or foam-like material which makes them very lightweight. The foam bodies 70, 71 can be formed into any shape or profile, such as, in this case, a portable boom box or sound system and a microphone. A portion of the foam bodies 70, 71 is hollowed out to accommodate one or more electronic or other devices. In the present embodiment, these devices may include a sound module operative to store and playback at least one audio file, a speaker 63, an amplifier, a microphone 61, a power source 65 such as one or more disposable batteries, a circuit board, an integrated circuit chip, and any other component which accommodates amplifying input from a microphone along with pre-recorded background music and projecting it out through a speaker. The faux boom box 62 is substantially rectangular in shape however other shapes have been contemplated and are considered to be within the scope of the invention. The electronic components are contained and concealed within one or more cavities formed in the foam. The foam 70, 71 may have a single cavity or multiple cavities and the cavity or cavities may extend through the foam 70, 71 from the front surface through the back surface or they may only extend partially into the foam 70, 71. The front and back surfaces of the foam body 70, 71 are generally planar and can be covered with a heavy gauge paper-like material such as paper, cardboard, cardstock, or any other suitable sheet material. The outer paper-like surface 66, 67 can be cut in the shape of the foam body 70, 71 and printed with a design consistent with the shape of the foam body. The front surface material 66A, 67A may bear decoration consistent with a front view of the item and the back surface material 66B, 67B may contain decoration consistent with a back view of the item. For example, in the embodiment shown in FIG. 14, the foam 70 is formed in a substantially rectangular shape with the front surface material 66A being printed with various dials and speakers consistent with the front face of a sound system or boom box. The back surface material 66B may contain printing thereon consistent with the back or rear view of a sound system or boom box, or it may not contain any printing at all. Likewise, the microphone foam body 71 is formed in an elongate shape with rounded edges consistent with a microphone with the front surface material 67A printed with a design consistent with the front view of a microphone. The front surface material 67A of the microphone 64 may also contain printed text indicating where the user must apply pressure to begin singing and hearing his/her voice amplified through the speakers. The outer surface material 66, 67 may be adhesively or otherwise attached to the foam bodies 70, 71 to conceal the cavity or cavities and the devices or device components contained therein. The greeting card 60 may contain, in addition to the three-dimensional foam bodies 70, 71 with front and back cover material 66, 67, a sentiment panel 68, which may be connected to the planar sheet material 66B located on the back surface of the foam body 70. This configuration is shown in FIG. 16. The sentiment panel 68 may be, as shown, shaped in the same way as the foam body 70 and corresponding cover material 66. The sentiment panel 68 is connected via a horizontal fold line located along a top edge of cover material 66B located on the back surface of the faux boom box 62 foam body 70 and serves as an outside back cover of the greeting card 60 and an inside panel of the greeting card 60. In a closed position, the sentiment panel 68 would be folded over the back surface of the greeting card 68. To open the greeting card 60, the faux boom box 62 foam body 70 is lifted in an upward direction away from the sentiment panel 68 along the horizontal fold line. The inside surface of the sentiment panel 68 and/or the back cover material 66B may contain printed text sentiment thereon or other artwork or graphics. The perimeter of the foam bodies 70, 71, which extends between the front and rear surfaces may be left uncovered or may be covered with the same or similar material. The faux boom box 62 contains a substantially rectangular horizontal retractable handle 72 which is located along a top edge of the faux boom box 62 foam body 70. The retractable handle 72 is operative to move between a first position wherein the handle 72 is partially contained within the faux boom box 62 foam body 70 and a second position wherein the handle 72 is substantially removed from within the faux boom box 62 foam body 70 to provide a way for the user to carry the faux boom box 62. As mentioned above, the foam bodies 70, 71 contain electrical and other components therein operative to store and playback audio files and amplify a user's voice being directed into the faux microphone 64. The faux microphone 64 contains an actual microphone 61 therein for receiving sound waves and converting those sound waves into an electrical signal which is in turn amplified and transmitted to the speaker 63 via a cable 73 which runs between the faux microphone 64 and the faux boom box 62. The cable 73 may contain a plastic coating thereon to protect the cable 73 from damage. The faux microphone 64 also contains a press button switch 74 which when depressed initiates playback of at least one pre-recorded audio file and begins converting the user's voice (directed into the faux microphone 64) or sound waves into an electrical signal which is passed to a speaker 63, such that the pre-recorded audio and the users voice are simultaneously emitted through the speaker or speakers. The user must push the press button 74 and hold it down for playback of the amplified background music and user's voice. Playback of the audio file and transmission of electrical signal to the speaker 63 ceases once the user releases the press button 74. The faux boom box 62 contains, in a preferred embodiment, two speakers 63 which are located at opposite ends of the faux boom box 62, as shown in FIG. 15. The user's amplified voice and the amplified pre-recorded background music are output through the two speakers 63 and through the front cover material 66A. The sound module may contain more than one pre-recorded audio file. The different audio clips may be replayed at random upon the user pressing the press-button or they may be played back in a specific order, or alternatively, the greeting card may contain additional controls through which a user can select a specific music clip to be replayed (and for the user to sing along to). The audio files may preferably contain musical clips (with no voice accompaniment) so that the user can clearly hear his/her voice singing along to the music. Alternatively, the audio files may contain music with voice accompaniment which the user can add his/her voice to as well. While this embodiment has been described as having a single press-button switch 74 which controls playback of both a pre-recorded audio file and amplification and emission of the user's voice directed into the microphone, other switches may be used so that playback of the pre-recorded audio and amplification and emission of the user's voice can be controlled by separate switches. In this case, the user may just wish to amplify his/her voice through the speaker 63 without the musical background. The greeting card 60 may also contain an on/off switch which controls power to the sound module, speaker, etc. The greeting card 60 may be packaged and displayed at retail in a clear or transparent bag or envelope 75, as shown in FIG. 17. The embodiment described herein and shown in FIGS. 14-17 are intended as examples only and are not meant to limit the invention in any way. Alternative graphics, text, foam shapes, arrangement and the number of components within the foam bodies, and alternative types and number of switches have been contemplated and are considered to be within the scope of the present invention.

The three-dimensional foam greeting cards of the present invention may also contain a battery-saving device which includes a small substantially rectangular plastic insert which is inserted into a small slot in the foam body. The slot is located directly outside the location of a battery circuit switch which is contained on the circuit board inside the foam body. When the device is inserted into the slot the circuit is opened, preventing batteries from draining while the product is not in use. When the device is removed, the circuit closes, and the batteries are activated, allowing the user to record a message, play an audio clip, light up the greeting card or cause components of the greeting card to be put in motion.

It should be noted that the three-dimensional foam greeting card described herein may contain one or a combination of two or more functions, as described, such as sound, light, audio, recording, motion, or multimedia functions. Additionally, a variety of switches are mentioned herein and can be used alone or in combination and may be located in a variety of locations on the three-dimensional foam greeting card.

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive. Other features and aspects of this invention will be appreciated by those skilled in the art upon reading and comprehending this disclosure. Such features, aspects, and expected variations and modifications of the reported results and examples are clearly within the scope of the invention where the invention is limited solely by the scope of the following claims.

What is claimed is:

1. An interactive foam greeting card comprising:

a first foam body having a front surface, a back surface and a perimeter surface between the front and back surfaces;

a second foam body having a front surface, a back surface and a perimeter surface between the front and back surfaces;

a sound module located within the first foam body, the sound module operative to store and replay at least one digital audio file;

one or more speakers located within the first foam body;

a microphone located within the second foam body;

a press button switch located within the second foam body;

wherein pushing and holding down the press button switch initiates playback of the at least one digital audio file, amplifies and emits the at least one digital file and a user's voice directed at a specially indicated section of the second foam body through the one or more speakers.

2. The interactive greeting card of claim 1, wherein the at least one digital audio file contains background music.

3. The interactive greeting card of claim 1, wherein the first foam body is shaped and decorated to look like a boom box and the second foam body is shaped and decorated to look like a microphone.

4. The interactive greeting card of claim 1, wherein the first foam body and the second foam body are connected via a cable.

5. The interactive greeting card of claim 1, wherein releasing the press button switch ceases playback of the at least one digital audio file and emission of the user's voice through the one or more speakers.

6. The interactive greeting card of claim 1, wherein the first foam body contains a handle located along a top edge of the first foam body, the handle operative to move between a first position wherein the handle is partially contained within the first foam body and a second position wherein the handle is substantially outside of the first foam body.

7. The interactive greeting card of claim 1, wherein a two panel greeting card is attached to the back surface of the first foam body.

8. An interactive greeting card comprising:

a first foam body shaped like a boom box, the first foam body having one or more speakers and a sound module operative to store and playback at least one digital audio file contained therein;

a second foam body shaped like a microphone, the second foam body having a microphone and a press button switch contained therein;

a cable which runs between the first foam body and the second foam body;

wherein when the press button switch is held down the at least one digital audio file is replayed and a user's voice directed into the microphone is captured as sound waves and converted to an electrical signal which is passed via the cable to the one or more speakers wherein the electrical signal is converted back to sound waves and projected therethrough.

9. The interactive greeting card of claim 8, wherein the at least one digital audio file contains background music.

10. The interactive greeting card of claim 8, wherein the first foam body contains a retractable handle.

11. The interactive greeting card of claim 8, wherein two speakers are located at opposite ends of the first foam body.

12. The interactive greeting card of claim 8, wherein the user's voice and at least one digital audio file are amplified before being projected through the speaker.

13. The interactive greeting card of claim 8, wherein a two panel greeting card is attached to a back surface of the first foam body.

14. The interactive greeting card of claim 8, wherein when the press button is released, the ate least one digital audio file ceases to play and the user's voices is no longer projected through the one or more speakers.

15. An interactive greeting card comprising:

a first foam body shaped like a boom box;

a second foam body shaped like a microphone;

at least one speaker located within the first foam body;

a microphone located within the second foam body;

a switch located within the second foam body;

wherein when the switch is activated and a user's voice is directed into the microphone, the user's voice is amplified and projected from the at least one speaker.

16. The interactive greeting card of claim 15 further comprising a sound module operative to store and playback at least one digital audio file containing background music.

17. The interactive greeting card of claim 16, wherein when the switch is activated, the background music is projected from the at least one speaker along with the user's voice.

18. The interactive greeting card of claim 15, wherein the switch is a press button switch.

19. The interactive greeting card of claim 15, wherein the first foam body has a retractable handle.

20. The interactive greeting card of claim 15, wherein the first foam body and the second foam body are connected via a cable.

* * * * *